US007972453B2

(12) United States Patent
Sheridan et al.

(10) Patent No.: US 7,972,453 B2
(45) Date of Patent: Jul. 5, 2011

(54) ENHANCED BLAST EXPLOSIVE

(75) Inventors: Edward W. Sheridan, Orlando, FL (US); George D. Hugus, Chuluota, FL (US); George W. Brooks, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 890 days.

(21) Appl. No.: 11/451,313

(22) Filed: Jun. 13, 2006

(65) Prior Publication Data

US 2011/0132222 A1 Jun. 9, 2011

(51) Int. Cl.

| | |
|---|---|
| ***C06B 45/00*** | (2006.01) |
| ***C06B 45/14*** | (2006.01) |
| ***C06B 45/04*** | (2006.01) |
| ***C06B 33/00*** | (2006.01) |
| ***D03D 23/00*** | (2006.01) |
| ***D03D 43/00*** | (2006.01) |

(52) U.S. Cl. ..... 149/37; 149/2; 149/15; 149/17; 149/109.2; 149/109.4

(58) Field of Classification Search ..... 149/37, 149/109.4, 2, 15, 17, 109.2
See application file for complete search history.

(56) References Cited

U.S. PATENT DOCUMENTS

| | | | | |
|---|---|---|---|---|
| 5,266,132 | A * | 11/1993 | Danen et al. | 149/15 |
| 5,717,159 | A | 2/1998 | Dixon et al. | |
| 5,912,069 | A | 6/1999 | Yializis et al. | |
| 6,679,960 | B2 * | 1/2004 | Jones | 149/19.3 |
| 6,843,868 | B1 | 1/2005 | Fawls et al. | |
| 6,955,732 | B1 * | 10/2005 | Chan et al. | 149/92 |

* cited by examiner

*Primary Examiner* — James E McDonough
(74) *Attorney, Agent, or Firm* — Buchanan Ingersoll & Rooney PC

(57) ABSTRACT

A thermobaric munition including a composite explosive material, the composite explosive material having a high-explosive composition, and a detonable energetic material dispersed within the high-explosive composition, the detonable energetic material in the form of a thin film, the thin film having at least one layer composed at least in part by a reducing metal and at least one layer composed at least in part by a metal oxide. A related method includes tailoring the blast characteristics of high explosive composition to match a predetermined time-pressure impulse, the method including disbursing a detonable energetic material having a preselected reaction rate within the high-explosive composition, the detonable energetic material in the form of a thin film, the thin film having at least one layer composed at least in part by a reducing metal and at least one layer composed at least in part by a metal oxide.

13 Claims, 3 Drawing Sheets

ENHANCED BLAST EXPLOSIVE

FIELD OF THE DISCLOSURE

The present disclosure relates to explosive compositions for munitions. More specifically, the present disclosure relates to structures and methods of tailoring the impulse of an explosive by the addition of rapidly reacting energy dense fuel.

BACKGROUND

Thermobaric weapons are able to overcome shortcomings of conventional blast/fragmentation and shaped-charge munitions with respect to certain targets. For example, conventional hard-target penetrating fragmentation bombs have shown shortcomings for defeating tunnels and caves. Fragments can be stopped by walls and do not necessarily penetrate through a containment system. By contrast, blast waves can travel around corners and their effects are not based on penetration. Conventional countermeasures such as physical barriers (e.g. sandbags) and personnel armor are not especially effective against thermobaric weaponry.

Detonation of a high explosive device produces a rapid, localized energy release. This energy is dissipated by the formation of a blast wave, thermal radiation, and the breakup of the munition casing and acceleration of the fragments. Thus, in conventional blast/fragmentation warheads, a large part of the initially released energy is consumed by the breakup of the casing and acceleration of the resulting fragments. By contrast, thermobaric weaponry usually employs relatively thin casings, and most of the released energy ends up as a fireball and a blast/shock wave. The level of structural damage and injury caused by the blast is dependent on peak pressure, impulse (a function of time and pressure), and the overall shape of the pressure-time curve.

FIG. 1 is a plot of blast overpressure versus duration required to produce lethal/severe damage upon an unprotected 70 kg soldier. As evidenced by the plot depicted in FIG. 1, overpressure duration on the order of 2-20 milliseconds (ms) results in the greatest probability of inflicting lethal or severe damage. Generally speaking, the longer a given overpressure is sustained, the lower the peak pressure necessary to achieve an equivalent disruptive or lethal effect. However, as evident from FIG. 1, this is not a linear relationship.

Thermobaric or enhanced blast munitions exploit secondary combustion of explosives as a source of lethal energy. In conventional systems, energy dense fuels, such as aluminum powder, have been added into an organic explosive. However, such metal powders burn relatively slowly such that while some energy is released in the 2-10 ms time frame, much of their energy is released at a later time after the initial pressure spike, and thus does not optimally contribute to sustaining a high positive impulse.

Relevant publications include U.S. Pat. Nos. 5,717,159; 5,912,069; 6,679,960 B2; and 6,843,868 B1, the entire disclosure of each of these publications is incorporated herein by reference.

SUMMARY

According to the present invention, explosive compositions, and associated methods, are provided that manipulate the burn rate of fuels in the explosive to enhance their lethal contribution in a thermobaric weapon by optimizing the overpressure versus time behavior of the resulting blast. As evidenced by FIG. 1, the largest change in this relationship is between 2-10 ms. Thus, one of the objectives in the production of thermobaric weapons according to the present invention can be to produce a blast having an overpressure versus time relationship (i.e., impulse) which is most likely to produce severe and/or lethal damage, or sustains an overpressure condition for at least about 2 ms, optionally at least about 5 ms, optionally at least about 10 ms, and optionally at least about 20 ms. Compositions of the present invention include providing mixtures of detonable energetic materials, preferably in the form of thin-films, with detonable explosives to produce benefits including an overall increase in the energy density of the composite explosive and an optimally sustainable overpressure spike.

According to one aspect of the present invention, there is provided a thermobaric munition comprising a composite explosive material, the composite explosive material comprising: a high-explosive composition; and a detonable energetic material dispersed within the high-explosive composition, the detonable energetic material comprising a thin film, the thin film comprises at least one layer comprising a reducing metal and at least one layer comprising a metal oxide.

According to another aspect of the present invention, there is provided a method of tailoring the blast characteristics of a high explosive composition to match a predetermined time-pressure impulse, the method comprising: disbursing a detonable energetic material having a preselected reaction rate within the high-explosive composition, the detonable energetic material comprising a thin film, the thin film comprises at least one layer comprising a reducing metal and at least one layer comprising a metal oxide.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
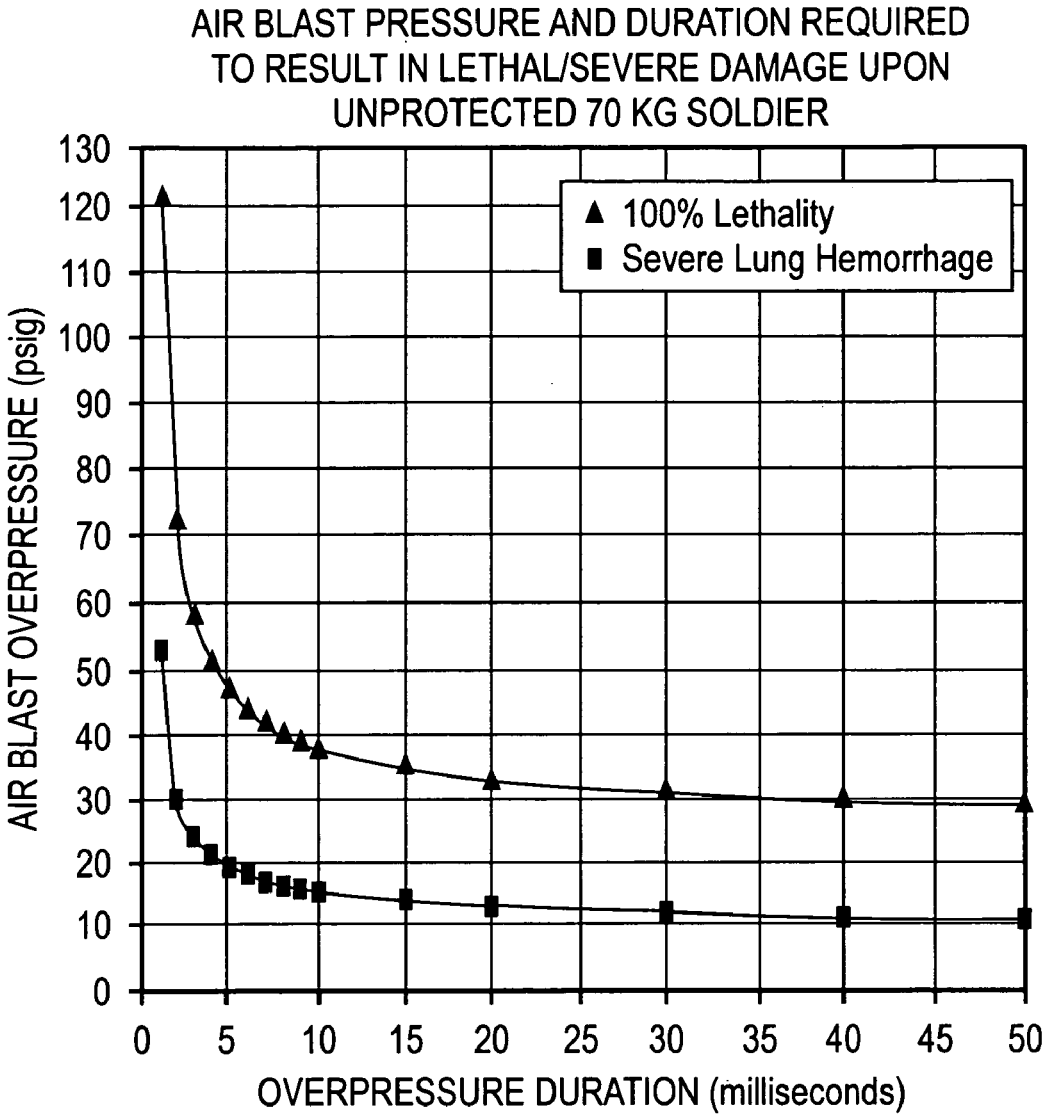
FIG. 1 is a plot of blast overpressure versus duration required to produce lethal/severe damage upon an unprotected 70 kg soldier.
Figure 2:
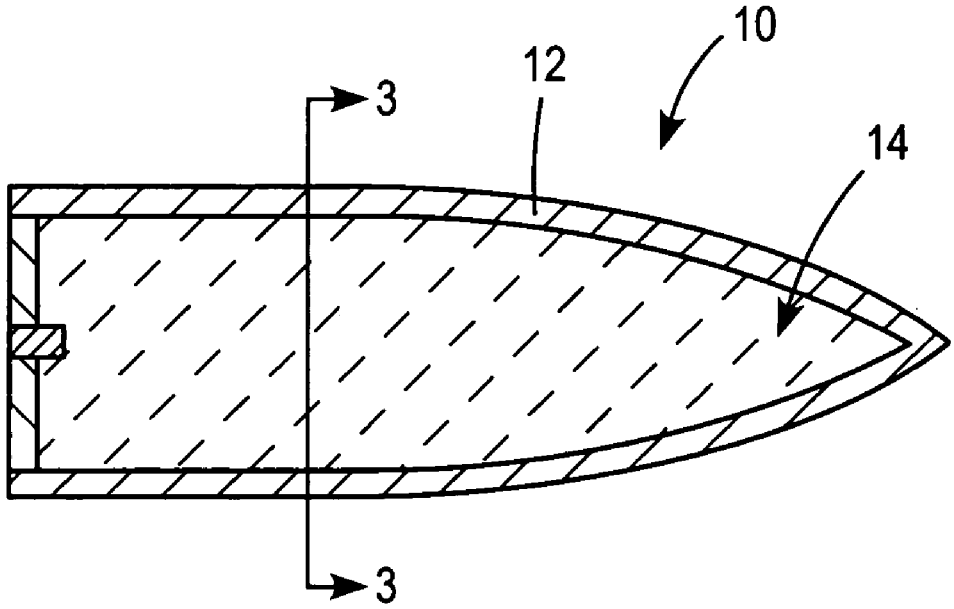
FIG. 2 is a sectional schematic illustration of the munition formed according to the principles of the present invention.

FIG. 2 illustrates a munition 10 formed according to the principles of the present invention, according to one embodiment thereof. The munition 10 illustrated in FIG. 1 is in the form of a thermobaric munition. The munition 10 includes a casing 12 comprising which contains a composite explosive material 14 formed according to the principles of the present invention. It should be understood that the composite explosive material 14 of the present invention can have a number of different applications, and thus is not limited to the illustrated combination with munition 10. According to non-limiting example, the munition 10 can comprise a BLU-82, JASSM, MK-84 or Hellfire MAC ordinance.

Figure 3:
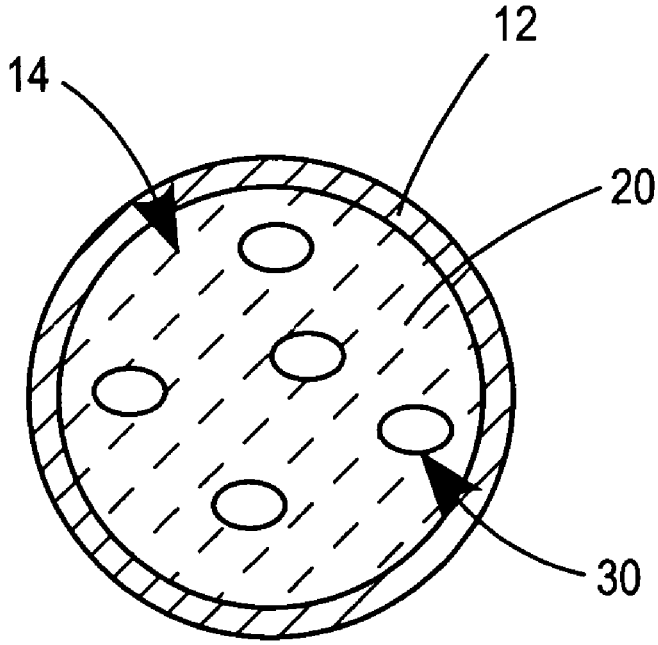
FIG. 3 is a cross-section of FIG. 2 take along line 3-3.

As illustrated in FIG. 3, and a composite explosive material 14 is formed, at least in part, by a high explosive composition 20 with a detonable energetic material 30 dispersed therein.

The high explosive composition 20 can be formed from any suitable explosive composition. By way of non-limiting example, the high explosive composition can be formulated in whole, or in part, by any suitable component(s), such as one or more of: PBXN-109, PBX-108, PBXIH-135, AFX-757, PBXC-129, HAS-13, RDX, HMX, TNT, PAX, and Tritonal™.

The detonable energetic material 30 may comprise a material, or combination of materials, which upon reaction, release thermal energy. One example of such a reaction is called a "thermite" reaction. Such reactions can be generally characterized as a reaction between a metal oxide and a reducing metal which upon reaction produces a metal, a different oxide, and heat. There are numerous possible metal oxide and reducing metals which can be utilized to form such reaction products. A generalized formula for the stoichiometry of this reaction can be represented as follows:

$$M_xO_y+M_Z=M_x+M_zO_y+\text{Heat}$$

wherein $M_xO_y$ is any of several possible metal oxides, $M_Z$ is any of several possible reducing metals, $M_x$ is the metal liberated from the original metal oxide, and $M_zO_y$ is a new metal oxide formed by the reaction. Thus, according to the principles of the present invention, the detonable energetic material 30 may comprise any suitable combination of metal oxide and reducing metal which as described above. For purposes of illustration, suitable metal oxides include: $La_2O_3$, CaO, BeO, $ThO_2$, MgO, $Li_2O$, SrO, $ZrO_2$, $Al_2O_3$, $UO_2$, BaO, $CeO_2$, $B_2O_3$, $TiO_2$, $SiO_2$, $V_2O_5$, $Ta_2O_5$, $Na_2O$, $MmO_2$, $Cr_2O_3$, ZnO, $K_2O$, $P_2O_5$, $SnO_2$, $WO_3$, $Fe_3O_4$, $MoO_3$, CdO, NiO, CoO, $Sb_2O_3$, PbO, $Fe_2O_3$, $Cu_2O$, and CuO. For purposes of illustration, suitable reducing metals include: Al, Zr, Th, Ca, Mg, U, B, Ce, Be, and La. The reducing metal may also be in the form of an alloy or intermetallic compound of the above. For purposes of illustration, the metal oxide is an oxide of a transition metal. According to another example, the metal oxide is a copper or tungsten oxide. According to another alternative example, the reducing metal comprises aluminum or an aluminum-containing compound. By way of non-limiting example, suitable metal oxide/reducing metal pairs include: Al/$MoO_3$; Al/$Bi_2O_3$; AlCuO; and Al/$Fe_2O_3$.

Figure 4:
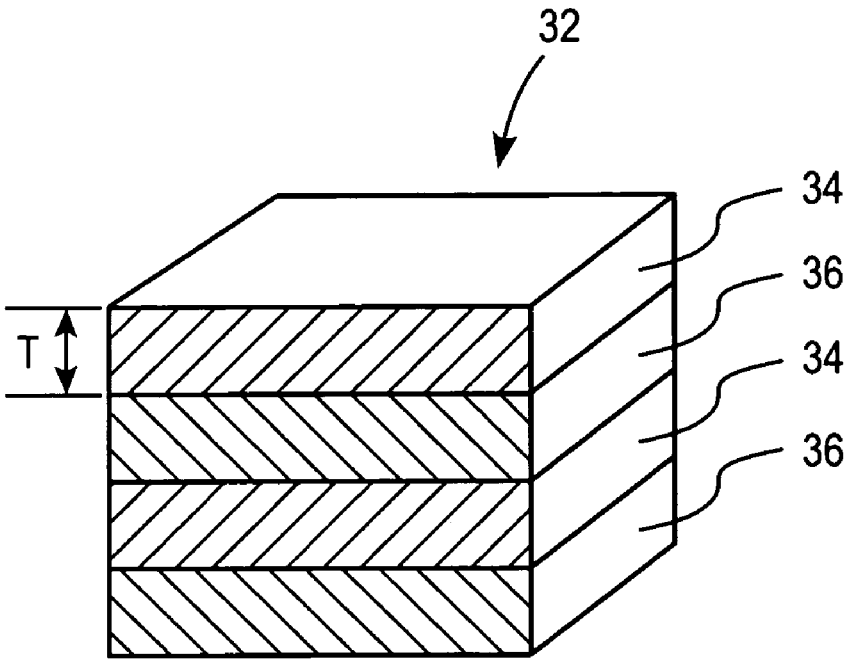
FIG. 4 is a schematic illustration of a detonable energetic thin-film material formed according to the principles of one embodiment of the present invention.

As noted above, the detonable energetic material 30 may have any suitable morphology. For example, as schematically illustrated in FIG. 4, the detonable energetic material 30 may be in the form of a thin film 32, and in having at least one layer of any of the aforementioned reducing metals 34, and at least one layer of any of the aforementioned metal oxides 36. The thickness T of the alternating layers can vary, and can be selected to impart desirable properties to the detonable energetic material 30. For purposes of illustration, the thickness T of layers 34 and 36 can be about 10 to about 1000 nm. The layers 34 and 36 may be formed by any suitable technique, such as chemical or physical deposition, vacuum deposition, sputtering (e.g., magnetron sputtering), or any other suitable thin film deposition technique. Each layer of reducing metal 34 present in the thin-film can be formed from the same metal. Alternatively, the various layers of reducing metal 34 can be composed of different metals, thereby producing a multilayer structure having a plurality of different reducing metals contained therein. Similarly, each layer of metal oxide 36 can be formed from the same metal oxide. Alternatively, the various layers of metal oxide 36 can be composed of different oxides, thereby producing a multilayer structure having different metal oxides contained therein. The ability to vary the composition of the reducing metals and/or metal oxides contained in the thin-film structure advantageously increases the ability to tailor the properties of the detonable energetic material 30, and thus the properties of the composite explosive material 14.

The composite explosive material 14 of the present invention can be formed according to any suitable method or technique.

Generally speaking, a suitable method for forming a composite explosive material of the present invention includes forming a detonable energetic material, combining the detonable energetic material with a high explosive composition, and optionally shaping the combined detonable energetic material and high explosive composition mixture to form a composite explosive material. In this regard, it is noted that, when the composite explosive material of the present invention is to be incorporated into a munition of the type depicted in FIG. 2, a high explosive composition/detonable energetic material mixture can be cast in place within a casing (e.g., 12). Alternatively, the mixture may be pre-shaped or preformed and subsequently loaded into a casing.

The detonable energetic material can be formed according to any suitable method or technique. For example, when the detonable energetic material is in the form of a thin film, as mentioned above, the thin-film detonable energetic material can be formed as follows. The alternating layers of oxide and reducing metal are deposited on a substrate using a suitable technique, such as vacuum deposition or magnetron sputtering. Other techniques may include mechanical rolling and ball milling to produce structures that are structurally similar to those produced by vacuum deposition. The deposition processes is controlled to provide the desired layer thickness, typically on the order of about 10 to about 1000 nm. The thin-film comprising the above-mentioned alternating layers is then removed from the substrate. Removal can be accomplished by a number of suitable techniques such as photoresist coated substrate lift off, preferential dissolution of coated substrates, and thermal shock of coating and substrate to cause determination. According to one embodiment, the inherent strain at the interface between the substrate and the deposited thin film is such that the thin-film will flake off the substrate with minimal or no effort.

The removed thin-film may then be reduced in size; preferably, in a manner such that the pieces of thin-film having a reduced size are also substantially uniform. A number of suitable techniques can be utilized to accomplish this. For example, the pieces of thin-film removed from a substrate can be worked to pass them through a screen having a desired mesh size, such as 25-60 mesh screen. This accomplishes both objectives of reducing the size of the pieces of thin-film removed from the substrate, and rendering the size of these pieces substantially uniform.

The above-mentioned reduced-size pieces of thin-film are then combined with a high explosive composition to form a mixture. The high explosive composition can be selected from any of the above-mentioned explosive compositions. This combination can be accomplished by any suitable technique. Optionally, the pieces of thin-film or the high explosive composition can be treated in a manner that functionalizes the surface(s) thereof, thereby promoting wetting of the pieces of thin-film in the high explosive composition. Such treatments are per se known in the art. For example, the particles can be coated with a material that imparts a favorable surface energy thereto.

This mixture can then optionally be shaped thereby forming, for example, an explosive charge ready for loading within a casing of a thermobaric munition. The mixture can be shaped by any suitable technique, such as molding, casting, pressing, forging, cold isostatic pressing, hot isostatic pressing, etc.

Figure 5:
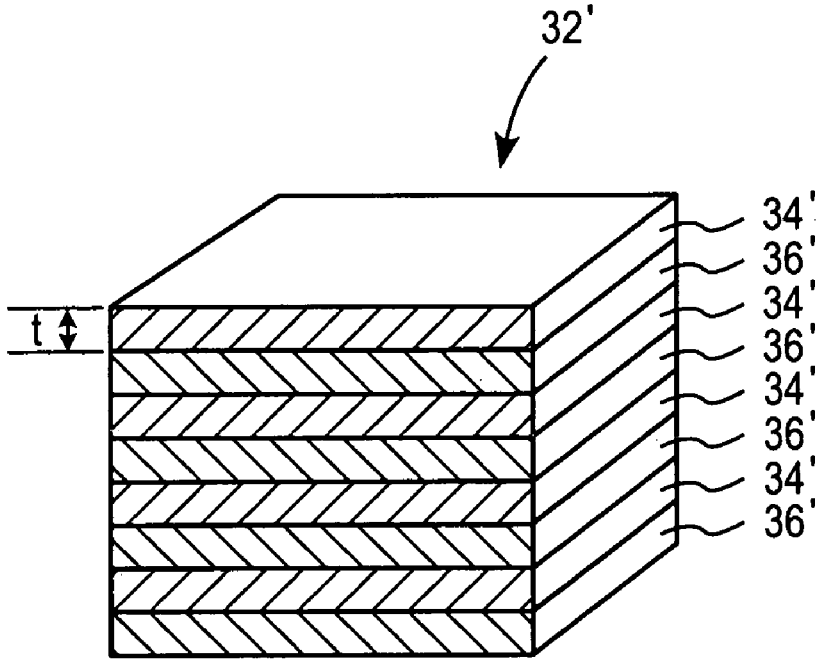
FIG. 5 is a schematic illustration of a detonable energetic than-film material formed according to the principles of an alternative embodiment of the present invention.

One advantage of a composite explosive material formed according to principles of the present invention is that both the composition and/or morphology of the reactive material 30 can be used to tailor the rate of release of chemical or thermal energy. While the total energy content of the reactive material is primarily a function of the mass of the reducing metal and metal oxide, the rate at which that energy is released is a function of the arrangement of the reducing metal and metal oxide relative to one another. For instance, the greater the degree of mixing between the reducing metal and metal oxide components of the detonable energetic material, the quicker the reaction that releases thermal energy will proceed. Consider the embodiment of the thin-film 32' depicted in FIG. 5 compared with the embodiment of the thin-film 32 depicted in FIG. 4. The layers of reducing metal 34' and metal oxide 36' contained in the thin-film 32' have a thickness t which is less than that of the thickness T of the layers in thin-film 32 (T>t). Otherwise, the size (i.e., volume) of the thin films 32 and 32' are the same. Thus, the total mass of reducing metal and the total mass of metal oxide contained in the two thin films are likewise the same. As a result, the total thermal energy released by the two films should be approximately the same. However, it is evident that the reducing metal and metal oxide are intermixed to a greater degree in the thin-film 32'. The thermal energy released by the thin-film 32' will proceed at a faster rate than the release of thermal energy from the thin-film 32. Thus, the timing of the release of thermal energy from a thin-film formed according to the principles of the present invention can be controlled to a certain extent by altering the thickness of the layers of reducing metal and metal oxide contained therein.

Similarly, the timing of the release of thermal energy from a thin-film formed according to the principles of the present invention can also be controlled, at least to some degree, by the selection of materials, and their location, within a thin-film. For example, in the thin-film 32' depicted in FIG. 5, the rate at which thermal energy is released can be altered by placing layers of metal oxide and/or reducing metal which have a greater reactivity toward the interior of the thin film 32', while positioning reducing metal and four/or metal oxide layers having a lower reactivity on the periphery (i.e. top and bottom). Since those layers located on the periphery of the thin-film 32' are presumably more susceptible to ignition due to their proximity to outside forces, these layers will begin to release thermal energy prior to those layers contained on the interior. By placing less reactive materials on the periphery, the overall reaction rate of the thin-film 32 can be slowed.

Thus, according to the principles of the present invention, the blast characteristics of a high explosive composition can be tailored to match a predetermined time-pressure impulse. This can be accomplished, at least in part, by disbursing a detonable energetic material having a preselected reaction rate within the high-explosive composition, the detonable energetic material comprising a thin film, the thin film comprises at least one layer comprising a reducing metal and at least one layer comprising a metal oxide. More specifically, the rate of release of thermal energy from the detonable energetic material is controlled, at least in part by one or more of: (i) selection of the composition of one or more of the reducing metal and metal oxide materials; and (ii) selection of the thickness of one or more of the reducing metal and metal oxide layers.

The use of thin-film detonable energetic materials is superior to similar materials in the form of metal powders in that the thin-film reaction rate can be more readily tailored to match the impulse, or overpressure versus time relationship in the human lethality curve (e.g., FIG. 1). The longer a given overpressure is sustained the lower peak pressure necessary to achieve an equivalent lethal effect. Thus, according to the principles of the present invention, the composite explosive material of the present invention can be tailored, via tailoring of the detonable thin-film energetic material to release all, or substantially all, of their stored energy within the desired time frame. For example, the detonable thin-film energetic material of the present invention can be designed to release substantially all of its thermal energy within about 20 ms, or within about 10 ms, or within about 5 ms. Slower burning metal powders will release some energy in this time frame, but much of their stored energy will be released after the initial pressure spike and not significantly contribute to sustaining a high positive impulse. The ability to tailor the energy release rate of the detonable thin-film energetic materials contained in the composite explosive material of the present invention to within 10 ms can significantly enhance the lethality of thermobaric weapons.

It is to be understood that the present invention encompasses weapons and weapon systems that include fragments and/or fragmentary action to impart kinetic energy to a target. The advantages of the therobaric properties provided by the present invention are readily combinable with the kinetic effects of fragmentary weapons. Thus, the term "thermobaric munition", and the like, as used herein, does not exclude weapons and weapons systems that include fragments and/or fragmentary action to impart kinetic energy to a target. Applicant reserves the right to exclude fragmentary weapons from the scope of the invention by using terminology such as "thermobaric munition lacking fragments."

All numbers expressing quantities of ingredients, constituents, reaction conditions, and so forth used in the specification are to be understood as being modified in all instances by the term "about". Notwithstanding that the numerical ranges and parameters setting forth, the broad scope of the subject matter presented herein are approximations, the numerical values set forth are indicated as precisely as possible. Any numerical value, however, inherently contains certain errors necessarily resulting from the standard deviation found in their respective measurement techniques.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A thermobaric munition comprising a composite explosive material, the composite explosive material comprising:

a high-explosive composition; and an energetic material dispersed within the high-explosive composition, the energetic material comprising a thin film, the thin film comprises at least one layer comprising a reducing metal and at least one layer comprising a metal oxide, wherein the thin film is in a form of at least one particle having a size such that the particle will pass through a 25-60 size mesh screen.

2. The munition of claim 1, wherein the layers each have a thickness of about 10 to about 1000 nm.

3. The munition of claim 1, wherein the reducing metal includes an element selected from the group consisting of Group I, II and III of the periodic table.

4. The munition of claim 1, wherein the metal oxide is an oxide of a transition metal element.

5. The munition of claim 1, wherein the reducing metal is aluminum or aluminum-based.

6. The munition of claim 4, wherein the metal oxide is copper oxide or tungsten oxide.

7. The munition of claim 1 comprising a casing, and wherein the composite explosive material is disposed within the casing.

8. The munition of claim 1, wherein the energetic material is formed such that upon detonation of the high explosive composition, the energetic material reacts within 20 ms.

9. The munition of claim 8, wherein the energetic material is formed such that upon detonation of the high explosive composition, the energetic material reacts within 10 ms.

10. The munition of claim 9, wherein the energetic material is formed such that upon detonation of a high explosive composition, the energetic material reacts within 5 ms.

11. A thermobaric munition comprising:

a casing; and a composite explosive material, the composite explosive material comprising:

a high-explosive composition; and an energetic material dispersed within the high-explosive composition, the energetic material comprising a thin film, the thin film comprises at least one layer comprising a reducing metal and at least one layer comprising a metal oxide, wherein the composite explosive material is disposed within the casing, and wherein the thin film is in a form of at least one particle having a size such that the particle will pass through a 25-60 size mesh screen.

12. The thermobaric munition of claim 1, wherein the plurality of particles are substantially uniform in size.

13. The thermobaric munition of claim 11, wherein the plurality of particles are substantially uniform in size.

* * * * *